US007805103B2

(12) United States Patent
Ueno et al.

(10) Patent No.: US 7,805,103 B2
(45) Date of Patent: Sep. 28, 2010

(54) CLEANING BLADE FOR REMOVING TONER

(75) Inventors: Miyuki Ueno, Tokyo (JP); Shuji Abe, Tokyo (JP); Shuhei Noda, Tokyo (JP)

(73) Assignee: Synztec Co., Ltd., Tokyo (JP)

( * ) Notice: Subject to any disclaimer, the term of this patent is extended or adjusted under 35 U.S.C. 154(b) by 105 days.

(21) Appl. No.: 12/146,981

(22) Filed: Jun. 26, 2008

(65) Prior Publication Data

US 2009/0003905 A1 Jan. 1, 2009

(30) Foreign Application Priority Data

Jun. 26, 2007 (JP) ..... 2007-168182
Jun. 23, 2008 (JP) ..... 2008-162881

(51) Int. Cl.
*G03G 21/00* (2006.01)

(52) U.S. Cl. ..... 399/350

(58) Field of Classification Search ..... 399/343, 399/350, 351
See application file for complete search history.

(56) References Cited

U.S. PATENT DOCUMENTS

2007/0140762 A1* 6/2007 Ueno et al. ..... 399/350

FOREIGN PATENT DOCUMENTS

JP 63-159892 7/1988
JP 2002-214989 7/2002
JP 2002-214990 7/2002
JP 2004-184462 7/2004

* cited by examiner

*Primary Examiner*—Hoang Ngo
(74) *Attorney, Agent, or Firm*—Young & Thompson

(57) ABSTRACT

A cleaning blade member includes a cleaning layer and an elastic layer provided on the cleaning layer's back surface. Both are formed of a polyurethane member produced through curing and molding a castable polyurethane composition, the cleaning layer containing a long-chain polyol, a polyisocyanate, and a diamino compound having a melting point≦80° C., the elastic layer containing a long-chain polyol, a polyisocyanate, a short-chain diol, and a short-chain triol, and has a percent edge drooping≦7.0%, the cleaning and elastic layers have Young's modulus contribution factors $R_a$ and $R_b$, respectively. $(R_b/R_a)=0.05\text{-}6.0$. $R_a=[T_aE_a/(T_a+T_b)]$. $R_b=[T_bE_b/(T_a+T_b)]$. $E_a$ and $E_b$ are Young's modulus of the cleaning and elastic layers, respectively. $T_a$ and $T_b$ represent the thicknesses of the cleaning and elastic layers, respectively, and the overall Young's modulus of the cleaning layer and elastic layer is $(R_a+R_b)=5.0\text{-}14.0$ MPa.

6 Claims, 2 Drawing Sheets

CLEANING BLADE FOR REMOVING TONER

The entire disclosure of Japanese Patent Applications Nos. 2007-168182 filed on Jun. 26, 2007 and 2008-162881 filed on Jun. 23, 2008 is expressly incorporated by reference herein.

BACKGROUND OF THE INVENTION

1. Field of the Invention

The present invention relates to a cleaning blade member and, more particularly, to a cleaning blade member for removing toner deposited on a toner image carrier employed in an electrophotographic process such as a photoconductor or a transfer belt, on which a toner image is formed and which transfers the formed image to an image receptor.

2. Background Art

Generally, in an electrophotographic process, electrophotographic apparatus parts such as an electrophotographic photoreceptor and a transfer belt are used cyclically and repeatedly, and toner deposited thereon is removed by means of a cleaning blade. The cleaning blade, which generally comes into contact with a photoreceptor over a long period of time, is required to have excellent wear resistance and a low friction coefficient. In response to the recent trend toward attaining a prolonged service life of units employed in electrophotographic apparatuses, photoreceptors have now a long service life. Thus, the cleaning blade must also have high durability.

In order to enhance the durability of a cleaning blade, the hardness thereof must be increased. However, when the hardness of a conventional single-layer cleaning blade is increased, excessive pressure is applied to a photoreceptor, resulting in exfoliation of a surface layer of the photoreceptor or edge drooping of the cleaning blade, which is problematic. As used herein, the term "edge drooping" refers to drooping of an edge of a cleaning blade, when the opposite edge portion is fixed horizontally on a support such that the surface opposite the photoreceptor contact side is directly placed on the support. Hitherto, there have been proposed some cleaning blades having a multi-layer structure for preventing edge drooping. Japanese Patent No. 2542204 and Japanese Patent Application Laid-Open (kokai) Nos. 2002-214989, 2002-214990, and 2004-184462 disclose those cleaning blades.

The proposed cleaning blades have a plurality of layers formed from different materials. Therefore, one component layer (e.g., a layer which contacts a photoreceptor) compensates for an unsatisfactory property of another component layer, and vice versa. However, wear resistance and edge droop resistance are still unsatisfactory and are to be further improved.

SUMMARY OF THE INVENTION

In view of the foregoing, an object of the present invention is to provide a high-durability cleaning blade member which exhibits excellent wear resistance and resistance to edge drooping (hereinafter referred to as "edge droop resistance").

Accordingly, in a first mode of the present invention for attaining the object, there is provided a cleaning blade member for use in cleaning means for removing toner deposited on an object, the cleaning blade member comprising a cleaning layer which contacts the object, and an elastic layer provided on the back surface of the cleaning layer, wherein the cleaning layer is formed of a polyurethane member produced through curing and molding a castable polyurethane composition containing a long-chain polyol, a polyisocyanate, and a diamino compound having a melting point of 80° C. or lower, the elastic layer is formed of a polyurethane member produced through curing and molding a castable polyurethane composition containing a long-chain polyol, a polyisocyanate, a short-chain diol, and a short-chain triol, and has a percent edge drooping of 7.0% or less, the cleaning layer has a Young's modulus contribution factor ($R_a$), and the elastic layer has a Young's modulus contribution factor ($R_b$), with the ratio ($R_b/R_a$) being 0.05 to 6.0, wherein $R_a$ is defined by formula (1):

$$R_a=[T_aE_a/(T_a+T_b)] \quad (1),$$

and $R_b$ is defined by formula (2):

$$R_b=[T_bE_b/(T_a+T_b)] \quad (2)$$

wherein $E_a$ represents the Young's modulus of the cleaning layer; $E_b$ represents the Young's modulus of the elastic layer; $T_a$ represents the thickness of the cleaning layer; and $T_b$ represents the thickness of the elastic layer, and the overall Young's modulus of the cleaning layer and the elastic layer as defined by ($R_a+R_b$) is 5.0 to 14.0 MPa.

A second mode of the present invention is drawn to a specific embodiment of the cleaning blade member of the first mode, wherein the diamino compound having a melting point of 80° C. or lower contains no chlorine atom but contains an aromatic ring in the molecular structure thereof and exhibits a reaction rate slower than that of 2,2',3,3'-tetrachloro-4,4'-diaminodiphenylmethane under given hardening and molding conditions.

A third mode of the present invention is drawn to a specific embodiment of the cleaning blade member of the first or second mode, wherein the polyurethane composition for forming the elastic layer contains the polyisocyanate in an amount of 20 to 45 parts by mass with respect to 100 parts by mass of the polyol, and has a ratio of the amount by mole of the short-chain triol to the total amount by mole of the short-chain diol and the short-chain triol of 0.4 or higher.

A fourth mode of the present invention is drawn to a specific embodiment of the cleaning blade member of any one of the first to third modes, which has a percent edge drooping of 8.0% or less.

The present invention can provide a high-durability cleaning blade member which exhibits excellent wear resistance and edge droop resistance.

BRIEF DESCRIPTION OF THE DRAWINGS

Various other objects, features, and many of the attendant advantages of the present invention will be readily appreciated as the same becomes better understood with reference to the following detailed description of the preferred embodiments when considered in connection with the accompanying drawings, in which.

DETAILED DESCRIPTION OF PREFERRED EMBODIMENTS

Figure 1:
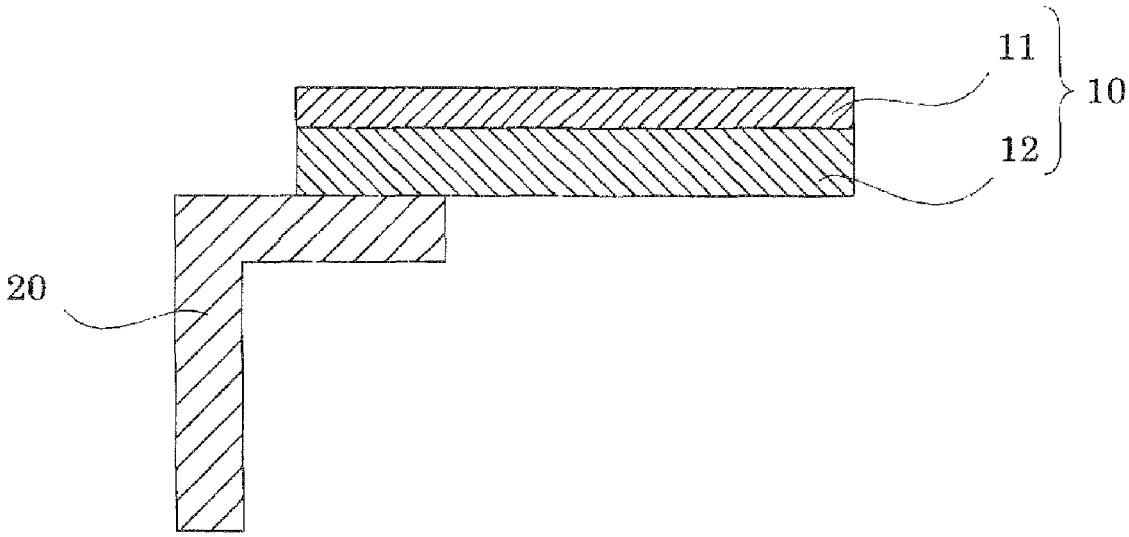
FIG. 1 is a transverse cross-section of an embodiment of the cleaning blade according to the present invention.

The cleaning blade of the present invention has two layers; i.e., a cleaning layer which contacts an object on which toner is deposited, and an elastic layer provided on the back surface of the cleaning layer. Characteristic features of the cleaning blade reside in that each of the cleaning layer and the elastic layer is formed of a specific polyurethane member, and that the percent edge drooping of the elastic layer, the ratio of the Young's modulus contribution factor of the elastic layer to that of the cleaning layer, and the Young's modulus of the cleaning blade member are limited within specific ranges, whereby durability of the cleaning blade; i.e., wear resistance and edge droop resistance, is enhanced.

In other words, the cleaning blade member of the present invention employs a cleaning layer formed of a polyurethane member produced by molding a polyurethane composition containing a diamino compound, an elastic layer formed of a polyurethane member exhibiting excellent edge droop resistance, the ratio of the Young's modulus contribution factor of the elastic layer to that of the cleaning layer, and the Young's modulus of the cleaning blade member are adjusted to fall within specific ranges. By virtue of these features, high durability of the cleaning blade; i.e., excellent wear resistance and edge droop resistance, can be attained.

The cleaning layer, which is a layer of the cleaning blade which contacts the object on which toner is deposited, is formed of a polyurethane member produced through curing and molding a castable polyurethane composition containing a polyol, a polyisocyanate, and a diamino compound having a melting point of 80° C. or lower. Since the cleaning layer is formed of a polyurethane member produced through curing and molding a polyurethane composition containing a diamino compound having a melting point of 80° C. or lower, the cleaning layer exhibits small variation in characteristics against temperature change, relatively high hardness, high mechanical strength (e.g., elongation at break or tensile strength), and excellent wear resistance.

The elastic layer is formed of a polyurethane member produced through curing and molding a castable polyurethane composition containing a polyol, a polyisocyanate, a short-chain diol, and a short-chain triol, and has a percent edge drooping of 7.0° or less. Through provision of such an elastic layer having a percent edge drooping of 7.0% or less, the cleaning blade member exhibits excellent edge droop resistance.

As described above, the cleaning blade member of the present invention is formed of a cleaning layer which is a polyurethane member exhibiting high hardness and excellent wear resistance, and an elastic layer provided on the back surface of the cleaning layer in order to compensate characteristics of the cleaning layer such as edge droop resistance. Therefore, the thus-provided bi-layer cleaning blade member is prevented from edge drooping and defoliation of a surface layer of a photoreceptor, even though the cleaning layer which contacts a toner-deposited object has an increased hardness.

In the cleaning blade member of the present invention, the ratio ($R_b/R_a$) is 0.05 to 6.0, wherein $R_a$ represents the Young's modulus contribution factor of the cleaning layer, $R_b$ represents the Young's modulus contribution factor of the elastic layer, $R_a$ is defined by formula (1):

$$R_a=[T_aE_a/(T_a+T_b)] \quad (1)$$

and $R_b$ is defined by formula (2):

$$R_b=[T_bE_b/(T_a-T_b)] \quad (2)$$

wherein $E_a$ represents the Young's modulus of the cleaning layer; $E_b$ represents the Young's modulus of the elastic layer; $T_a$ represents the thickness of the cleaning layer; and $T_b$ represents the thickness of the elastic layer, and the overall Young's modulus of the cleaning layer and the elastic layer defined by ($R_a$+$R_b$) is 5.0 to 14.0 MPa.

As described above, the parameter "Young's modulus contribution factor" of a component layer refers to a parameter obtained by multiplying the Young's modulus of the component layer (the cleaning layer or the elastic layer) by the ratio of the thickness of the component layer to the total thickness of the cleaning layer and the elastic layer in the cleaning blade. Thus, the parameter represents the degree of contribution in terms of Young's modulus of a component layer in the cleaning blade. Specifically, when the ratio ($R_b/R_a$), wherein $R_a$ represents the Young's modulus contribution factor of the cleaning layer and $R_b$ represents the Young's modulus contribution factor of the elastic layer, is 1, the contribution of the cleaning layer and that of the elastic layer to the Young's modulus of the entire cleaning blade member are almost equivalent. When the ratio is less than 1, the contribution of the cleaning layer predominates, whereas when the ratio is in excess of 1, the contribution of the elastic layer predominates.

As described above, the ratio of Young's modulus contribution factor of the elastic layer to that of the cleaning layer, $R_b/R_a$, is 0.05 to 6.0, preferably 0.5 to 2.5. When the Young's modulus contribution factor ratio is less than 0.05, the effect of the elastic layer is not significant, whereas when the ratio is greater than 6.0, the effect of the elastic layer excessively predominates, thereby failing to realize characteristics of the cleaning layer.

The Young's modulus of the cleaning blade member may be determined through measuring the Young's modulus of the blade member including the two layers as one piece. However, in the present invention, the sum of Young's modulus contribution factor $R_a$ and Young's modulus contribution factor $R_b$, ($R_a$+$R_b$), is employed as the Young's modulus of the cleaning blade member. The ($R_a$+$R_b$) is 5.0 to 14.0 MPa, preferably 6.0 to 12.0 MPa. When the Young's modulus falls within the range, the cleaning blade member gives no damage to a photoreceptor or a similar member, and high wear resistance can be attained. In contrast, when ($R_a$+$R_b$) is higher than 14.0 MPa, a photoreceptor may be damaged, whereas when the sum is lower than 5.0 MPa, the cleaning blade member may be worn.

The cleaning layer preferably has a Young's modulus of 8.0 to 20.0 MPa. When the Young's modulus is higher than 20.0 MPa, the cleaning blade member may cause damage to a photoreceptor, whereas when the Young's modulus is lower than 8.0 MPa, the cleaning blade member may have a reduced wear resistance.

As mentioned above, the cleaning layer is a castable polyurethane member produced through curing and molding a polyurethane composition containing a long-chain polyol, a polyisocyanate, and a diamino compound having a melting point of 80° C. or lower. The diamino compound employed in the composition has a melting point of 80° C. or lower. This is important because, for proceeding a reaction, the composition must be heated to a temperature equal to or higher than the melting point of the diamino compound, and if the reaction temperature is 80° C. or higher, pot life of the reaction system is considerably shortened. When the pot life of the composition is shortened, the composition cannot be molded or dimensional precision of the molded products is impaired. As used herein, the term "pot life" refers to a period of time during which the relevant material has comparatively low viscosity and maintains fluidity.

In addition, preferably, the diamino compound contains no chlorine atom but contains an aromatic ring in the molecular structure thereof and exhibits a reaction rate slower than that of 2,2',3,3'-tetrachloro-4,4'-diaminodiphenylmethane (TCDAM) under given hardening and molding conditions. In the case that the aforementioned diamino compound contains no chlorine atom, the compound has substantially no steric hindrance, and the diamino compound contains no chlorine atom and has an aromatic ring, polyurethane hardened with the diamino compound exhibits small variation in physical properties with temperature, excellent mechanical strength, and excellent wear resistance. When the diamino compound exhibiting a reaction rate slower than that of 2,2',3,3'-tetrachloro-4,4'-diaminodiphenylmethane is employed in production of polyurethane, failure of sheet formation due to excessively fast reaction rate can be prevented.

Among diamino compounds, at room temperature, some assume a liquid form and others assume a solid form. Of these, liquid-form diamino compounds are preferred. Examples of the diamino compound satisfying the conditions include diaminodiphenylmethane compounds and phenylenediamine compounds. Specific examples include 4,4'-methylenedianiline (DDM), 3,5-dimethylthio-2,4-toluenediamine (DMTDA), 2,4-toluenediamine (2,4-TDA), 2,6-toluenediamine (2,6-TDA), methylenebis(2-ethyl-6-methylamine), 1,4-di-sec-butylaminobenzene, 4,4-di-sec-butylaminediphenylmethane, 1,4-bis(2-aminophenyl) thiomethane, diethyltoluenediamine, trimethylenebis(4-aminobenzoate), and polytetramethylene oxide di-p-aminobenzoate.

Examples of the long-chain polyol employed in the polyurethane member forming the cleaning layer include polyester-polyols (produced through dehydration condensation between diol and dibasic acid), polycarbonate-polyols (produced through reaction between diol and alkyl carbonate), caprolactone-type polyols, and polyether-polyols. The long-chain polyol preferably has a number average molecular weight of 1,500 to 3,800, more preferably 1,650 to 3,000.

The polyisocyanate employed in the polyurethane member forming the cleaning layer preferably has a non-rigid structure. Examples of such polyisocyanates include 4,4'-diphenylmethane diisocyanate (MDI), 2,6-toluene diisocyanate (TDI), 1,6-hexane diisocyanate (HDI), 1,5-naphthalene diisocyanate (NDI), and 3,3-dimethylphenyl-4,4-diisocyanate (TODI). Of these, MDI is particularly preferred. The polyisocyanate content is preferably 30 to 80 parts by mass (unless otherwise specified, the unit "part(s)" is on the mass basis) with respect to 100 parts of polyurethane. When the polyisocyanate content falls within the range, the cleaning layer exhibits high tensile strength and excellent wear resistance. In contrast, when the polyisocyanate content is less than 30 parts, tensile strength may be poor, whereas when the content is in excess of 80 parts, permanent elongation may increase excessively.

In the polyurethane member forming the cleaning layer, the diamino compound is employed as a cross-linking agent. In addition to the diamino compound, a short-chain diol or a short-chain triol is preferably used in combination. No particular limitation is imposed on the type of the short-chain diol, and propanediol (PD), butanediol (BD), etc. may be used. The short-chain diol is added in order to promote crystallization for attaining satisfactory mechanical strength. No particular limitation is imposed on the type of the short-chain triol, and a short-chain triol having a molecular weight of 120 to 4,000 is preferred, with a triol having a molecular weight of 120 to 1,000 being more preferred. Specific examples include short-chain triols such as trimethylolethane (TME) and trimethylolpropane (TMP). The short-chain triol is added in order to improve characteristics such as creep and stress relaxation.

Notably, the bifunctional cross-linking agent such as a diamino compound or a short-chain diol, and the tri-functional cross-linking agent such as a short-chain triol may be used in combination, and two or more bi-functional cross-linking agents, or two or more tri-functional cross-linking agents may be used in combination.

No particular limitation is imposed on the amount of cross-linking agent in the polyurethane member forming the cleaning layer. The tri-functional cross-linking agent content (mole ratio) of the cross-linking agent is preferably 0 to 0.60, more preferably 0.05 to 0.40.

The elastic layer is formed of a polyurethane member produced through curing and molding a castable polyurethane composition containing a polyol, a polyisocyanate, a short-chain diol, and a short-chain triol. The same polyol, polyisocyanate, short-chain diol, and short-chain triol as employed in the polyurethane composition for forming the cleaning layer may also be employed in the polyurethane composition for forming the elastic layer. The polyurethane composition for forming the elastic layer may contain a similar diamino compound as employed in the polyurethane composition for forming the cleaning layer.

Preferably, the polyurethane composition forming the elastic layer contains 20 to 45 parts by mass of polyisocyanate with respect to 100 parts by mass of polyol and has a ratio by mole of short-chain triol to the sum of short-chain triol and short-chain diol of 0.4 or higher. When the above conditions are satisfied, an elastic layer having excellent edge droop resistance can be formed. When the amount of polyisocyanate is 20 to 45 parts by mass with respect to 100 parts by mass of polyol, the formed elastic layer exhibits excellent edge droop resistance. Since short-chain triol reacts with polyisocyanate to thereby form a network chain structure, the polyurethane member produced through molding the composition exhibits enhanced mechanical strength and edge droop resistance, as the mole ratio of short-chain triol increases. In contrast, when the amount of polyisocyanate is less than 20 parts with respect to 100 parts of polyol, hardening performance of the composition decreases due to decrease in number of urethane bonds, resulting in very poor mechanical strength of the polyurethane member produced through molding the composition, whereas when the amount of polyisocyanate is in excess of 45 parts, the molded polyurethane member is readily crystallized, resulting in edge drooping. When the ratio by mole of short-chain triol to the sum of short-chain triol and short-chain diol is less than 0.4, the cross-linking density of the network chain structure decreases, readily resulting in edge drooping.

Preferably, the polyurethane member forming the cleaning layer and that forming the elastic layer have an $\alpha$ value of 0.7 to 1.0. The term "$\alpha$ value" refers to a value calculated by the following equation:

$\alpha$ value=(amount (mol) of functional groups in cross-linking agent)/(amount (mol) of isocyanate groups remaining after reaction between polyol and polyisocyanate). When the $\alpha$ value is more than 1.0, functional groups such as a hydroxyl group or a diamino group of the cross-linking agent remain and stain a photoreceptor of a similar member which the blade contacts, whereas when the $\alpha$ value is less than 0.7, cross-linking density may lower excessively, resulting in poor mechanical strength, or may stain a photoreceptor due to a long period of time required for the deactivation of remaining isocyanate groups.

Notably, through modifying the amount of the aforementioned polyol, polyisocyanate, or cross-linking agent, or the composition of the cross-linking agent, the formed polyurethane member can possess mechanical characteristics of interest.

FIG. 1 is a transverse cross-section of an embodiment of the cleaning blade according to the present invention. As shown in FIG. 1, a cleaning blade member 10 is composed of a cleaning layer 11 and an elastic layer 12. An edge portion on the side of the elastic layer is affixed onto a support member 20, to thereby provide a cleaning blade.

The elastic layer has a percent edge drooping of 7.0% or less, preferably 6.0% or less. The "percent edge drooping" is calculated through the following procedure.

Figure 2A:
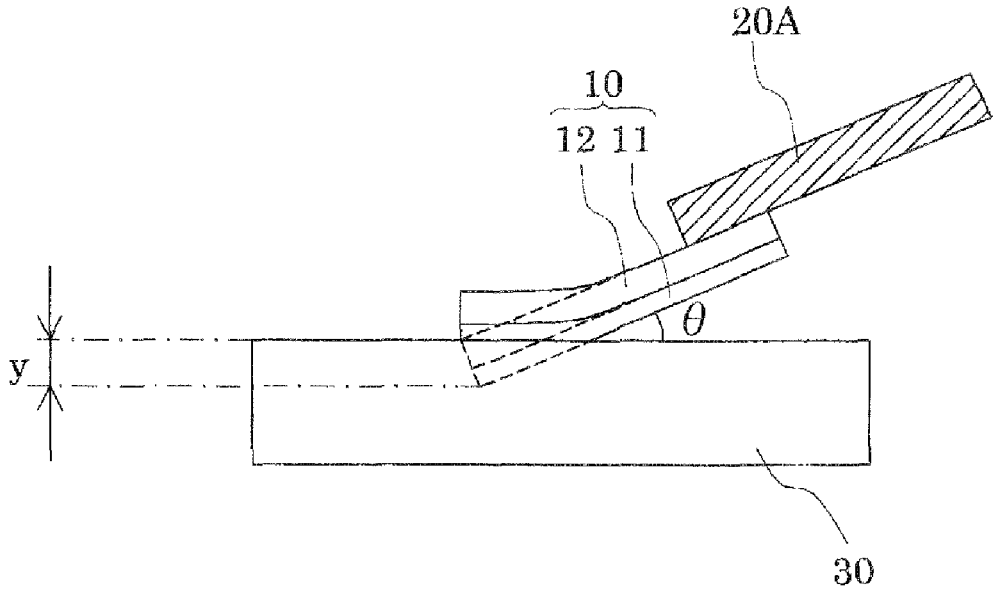
FIGS. 2A and 2B are cross-sections of a part of a cleaning blade during measurement of the percent edge drooping of the blade.
Figure 2B:
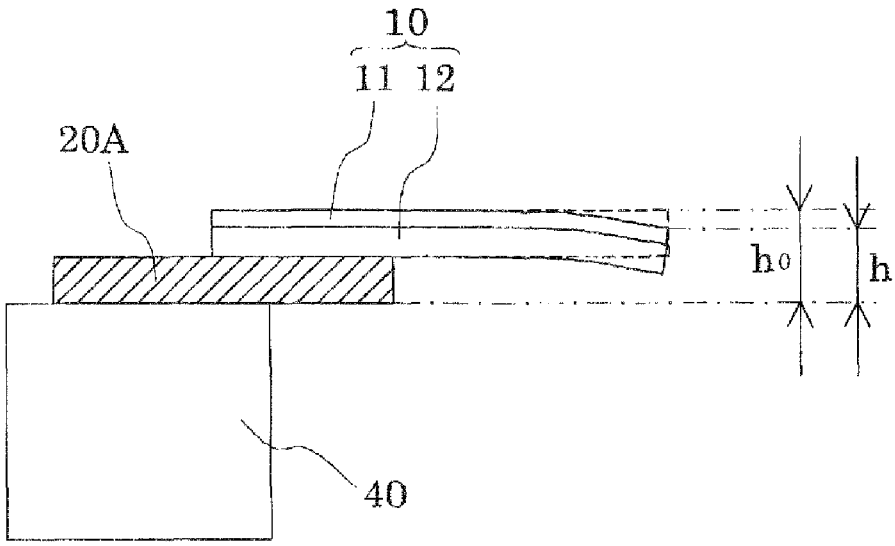

As shown in FIG. 2A, a cleaning blade in which the cleaning blade member 10 composed of the cleaning layer 11 and the elastic layer 12 is affixed to a holder member 20A is caused to be pressed against a press base plate 30 at an initial press angle θ of 25° and a deformation y of 1.7 mm. In this state, the thus-pressed cleaning blade is allowed to stand for 120 hours (45° C.×80% humidity). The blade and the press base plate are then removed from the atmosphere of the above conditions and allowed to stand at ambient temperature for six hours while the blade is maintained in the pressed state. Thereafter, the blade is released from the press base plate 30 and allowed to stand at ambient temperature for 30 minutes. As shown in FIG. 2B, the holder member 20A is affixed to a fixing jig 40, and the edge height h is measured by means of a pick tester employing a height gauge. The amount of edge drooping is obtained by subtracting the measured edge height from the initial edge height ($h_0$−h). Percent edge drooping is calculated from the following equation (4):

$$\text{Percent edge drooping (\%)}=100(h_0-h)/h_0 \quad (4)$$

The cleaning blade member employing the aforementioned elastic layer exhibits excellent edge droop resistance. The cleaning blade member preferably has a percent edge drooping of 8.0% or less. This is because when the percent edge drooping of a cleaning blade member increases, contact pressure of the blade decreases, impairing cleaning performance.

The elastic layer preferably has a permanent elongation (100%) of 0.8% or less. When the permanent elongation (100%) of the elastic layer increases, the cleaning blade member employing the elastic layer exhibits a large edge drooping during use thereof. In this case, contact pressure of the blade decreases, impairing cleaning performance.

According to the present invention, preferably, the cleaning layer has a hardness (JIS A) of 70 to 90°, and the elastic layer has a hardness (JIS A) of 60 to 80°. The hardness of the cleaning layer which contacts a toner-deposited object is higher, and the hardness of the elastic layer provided on the back surface of the cleaning layer is lower as compared with that of the cleaning layer, and thus the cleaning blade member of the invention exhibits high durability; i.e., excellent wear resistance and excellent edge droop resistance.

The cleaning blade member of the present invention may be produced through a production method for polyurethane generally employed in the art, such as the pre-polymer method or the one-shot method. Preferably, the centrifugal molding method is employed.

When the cleaning blade member is produced through the centrifugal molding method, a cleaning layer material and an elastic layer material are sequentially fed to a drum of a centrifugal molding apparatus while the drum is rotated at a predetermined rotational rate. For example, an elastic layer material is firstly fed into a drum and centrifugal-molded, to thereby form an elastic layer, and subsequently, a cleaning layer material is fed into the drum and molded, to thereby form a cleaning layer on the elastic layer. In this process, preferably, a material for forming the second layer is fed into the drum before complete curing of the first layer. Through this preferred feeding manner, the two layers can be formed into one piece. Meanwhile, the surface of the second forming layer; i.e., the air-contact surface, is more flat than the surface of the first forming layer which is in contact with a mold. Therefore, the air-contact surface preferably serves as a cleaning layer which contacts a charged member.

However, the molding method for producing the cleaning blade member is not limited to the aforementioned procedure. For example, there may be employed a method in which a cleaning layer is formed through casting on an elastic layer which has been formed through casting or a similar method, or a method in which a cleaning layer is formed through dipping or spraying.

The thus-produced polyurethane molded products are cut to provide cleaning blade member pieces having predetermined dimensions. When any of the cleaning blade member pieces is bonded to a support member by use of an adhesive or like material, a cleaning blade is produced.

EXAMPLES

The present invention will next be described in detail by way of examples, which should not be construed as limiting the invention thereto. In the Examples, Comparative Examples, and Test Examples, polyurethanes A to J were produced, and test cleaning blades were produced from the polyurethanes.

Polyurethane A 1,9-ND adipate (produced from 1,9-nonanediol and adipic acid) (molecular weight: 2,000) (100 parts), 4,4'-diphenylmethane diisocyanate (MDI) (50 parts), and propanediol (PD)/3,5-dimethylthio-2,4-toluenediamine (DMTDA)/trimethylolethane (TME) serving as a cross-linking agent were mixed at such proportions that the α value, the diamino compound content (ratio by mole) of the bi-functional cross-linking agent, and the tri-function ratio (by mole) of the cross-linking agent were adjusted to 0.95, 0.05, and 0.05, respectively. The mixture was allowed to react, to thereby produce polyurethane A.

Polyurethane B

Polytetramethylene ether glycol (PTMG) (molecular weight: 1,400) (100 parts), 4,4'-diphenylmethane diisocyanate (MDI) (55 parts), and butanediol (BD)/3,5-dimethylthio-2,4-toluenediamine (DMTDA)/trimethylolpropane (TMP) serving as a cross-linking agent were mixed at such proportions that the α value, the diamino compound content (ratio by mole) of the bi-functional cross-linking agent, and the tri-function ratio (by mole) of the cross-linking agent were adjusted to 0.95, 0.10, and 0.10, respectively. The mixture was allowed to react, to thereby produce polyurethane B.

Polyurethane C

Polycaprolactone (PCL) (molecular weight: 2,000) (100 parts), 3,3-dimethylphenyl-4,4-diisocyanate (TODI) (35 parts), and 3,5-dimethylthio-2,4-toluenediamine (DMTDA) serving as a cross-linking agent were mixed at such proportions that the α value was adjusted to 0.95. The mixture was allowed to react, to thereby produce polyurethane C.

Polyurethane D 1,9-ND adipate (produced from 1,9-nonanediol and adipic acid) (molecular weight: 2,000) (100 parts), 4,4'-diphenylmethane diisocyanate (MDI) (37 parts), and propanediol (PD)/trimethylolethane (TME) serving as a cross-linking agent were mixed at such proportions that the α value and the tri-function ratio (by mole) of the cross-linking agent were adjusted to 0.95 and 0.50, respectively. The mixture was allowed to react, to thereby produce polyurethane D.

Polyurethane E 1,9-ND adipate (produced from 1,9-nonanediol and adipic acid) (molecular weight: 2,000) (100 parts), 4,4'-diphenylmethane diisocyanate (MDI) (43 parts), and propanediol (PD)/trimethylolethane (TME) serving as a cross-linking agent were mixed at such proportions that the α value and the tri-function ratio (by mole) of the cross-linking agent were adjusted to 0.95 and 0.40, respectively. The mixture was allowed to react, to thereby produce polyurethane E.

Polyurethane F 1,9-ND adipate (produced from 1,9-nonanediol and adipic acid) (molecular weight: 2,000) (100 parts), 4,4'-diphenylmethane diisocyanate (MDI) (20 parts), and propanediol (PD)/trimethylolethane (TME) serving as a cross-linking agent were mixed at such proportions that the α value and the tri-function ratio (by mole) of the cross-linking agent were adjusted to 0.95 and 0.60, respectively. The mixture was allowed to react, to thereby produce polyurethane F.

Polyurethane G 1,9-ND adipate (produced from 1,9-nonanediol and adipic acid) (molecular weight: 2,000) (100 parts), 4,4'-diphenylmethane diisocyanate (MDI) (55 parts), and propanediol (PD)/trimethylolethane (TME) serving as a cross-linking agent were mixed at such proportions that the α value and the tri-function ratio (by mole) of the cross-linking agent were adjusted to 0.95 and 0.20, respectively. The mixture was allowed to react, to thereby produce polyurethane G.

Polyurethane H 1,9-ND adipate (produced from 1,9-nonanediol and adipic acid) (molecular weight: 2,000) (100 parts), 4,4'-diphenylmethane diisocyanate (MDI) (50 parts), and propanediol (PD)/trimethylolethane (TME) serving as a cross-linking agent were mixed at such proportions that the α value and the tri-function ratio (by mole) of the cross-linking agent were adjusted to 0.95 and 0.25, respectively. The mixture was allowed to react, to thereby produce polyurethane H.

Polyurethane I

Polycaprolactone (PCL) (molecular weight: 2,000) (100 parts), 4,4'-diphenylmethane diisocyanate (MDI) (40 parts), and butanediol (BD)/2,2',3,3'-tetrachloro-4,4'-diaminodiphenylmethane (TCDAM)/trimethylolpropane (TMP) serving as a cross-linking agent were mixed at such proportions that the α value, the diamino compound content (ratio by mole) of the bi-functional cross-linking agent, and the tri-function ratio (by mole) of the cross-linking agent were adjusted to 0.95, 0.05, and 0.10, respectively. The mixture was allowed to react, to thereby produce polyurethane I.

Polyurethane J

Polycaprolactone (PCL) (molecular weight: 2,000) (100 parts), 4,4'-diphenylmethane diisocyanate (MDI) (40 parts), and butanediol (BD)/Curehard MED/trimethylolethane (TME) serving as a cross-linking agent were mixed at such proportions that the α value, the diamino compound content (ratio by mole) of the bi-functional cross-linking agent, and the tri-function ratio (by mole) of the cross-linking agent were adjusted to 0.95, 0.10, and 0.10, respectively. The mixture was allowed to react, to thereby produce polyurethane J.

Test Example 1

The physical properties of the test samples of polyurethanes A to J were determined. Rubber hardness was determined in accordance with JIS K6301. Young's modulus (25% elongation, at 23° C.) was determined in accordance with JIS K6254. Tensile strength at 100% elongation (100% modulus), tensile strength at 200% elongation (200% modulus), and tensile strength at 300% elongation (300% modulus) were determined in accordance with JIS K6251. Tensile strength and elongation at breakage were determined in accordance with JIS K6251. Tear strength was determined in accordance with JIS K6252. Permanent elongation was determined in accordance with JIS K6262. Rebound resilience ($R_b$) at 10° C. to 50° C. was determined by means of a Lubke pendulum rebound resilience tester in accordance with JIS K6255, whereby temperature dependency thereof was evaluated. The results are shown in Table 1.

Test Example 2

As shown in FIG. 2A, each of the test samples of polyurethanes A to J was affixed onto a holder member 20A and was caused to be pressed against a press base plate 30 at an initial press angle θ of 25° and a deformation y of 1.7 mm. In this state, the thus-pressed cleaning blade was allowed to stand for 120 hours (45° C.×80% humidity). The blade and the press base plate were then removed from the atmosphere of the above conditions and allowed to stand at ambient temperature for six hours while the blade was maintained in the pressed state. Thereafter, the blade was released from the press base plate 30 and allowed to stand at ambient temperature for 30 minutes. As shown in FIG. 2B, the holder member 20A was affixed to a fixing jig 40, and the edge height h is measured by means of a pick tester employing a height gauge, whereby percent edge drooping was obtained.

TABLE 1

| | A | B | C |
|---|---|---|---|
| Polyol | 1,9-ND adipate | PTMG | PCL |
| Molecular weight of polyol | 2,000 | 1,400 | 2,000 |
| Polyisocyanate | MDI | MDI | TODI |
| Amount of polyisocyanate (parts) | 50 | 55 | 35 |
| Bi-functional crosslinking agent | PD/DMTDA | BD/DMTDA | DMTDA |
| Melting point of diamino compound | 4 | 4 | 4 |
| Relative reaction rate of diamino compound (vs. TCDAM) | 0.5 | 0.5 | 0.5 |
| Tri-functional crosslinking agent | TME | TMP | — |
| α value | 0.95 | 0.95 | 0.95 |
| Diamino compound (mole ratio) in bi-functional crosslinking agent | 0.05 | 0.10 | 1.00 |

TABLE 1-continued

| | | | | |
|---|---|---|---|---|
| Triol content (mole ratio) of crosslinking agent | | 0.05 | 0.10 | — |
| Moldability | | ○ | ○ | ○ |
| Hardness | JIS K6301 | 78 | 75 | 84 |
| 100% M (MPa) | JIS K6251 | 7 | 7 | 6 |
| 200% M (MPa) | JIS K6251 | 11 | 10 | 8 |
| 300% M (MPa) | JIS K6251 | 21 | 20 | 14 |
| Tensile strength (MPa) | JIS K6251 | 49 | 40 | 50 |
| Elongation at breakage (%) | JIS K6251 | 405 | 380 | 500 |
| Tear strength (kN/m) | JIS K6252 | 93 | 70 | 100 |
| Young's modulus (MPa) | JIS K6254 | 10.1 | 8.0 | 14.0 |
| Permanent elongation (%) | JIS K6262 | 2.6 | 2.0 | 3.0 |
| Rebound resilience (%) | 10 | 26 | 25 | 38 |
| | 25 | 44 | 40 | 49 |
| | 50 | 60 | 55 | 53 |
| | Δ50-10 | 34 | 30 | 15 |
| Percent edge drooping (%) | | 8.3 | 7.5 | 8.7 |

| | | D | E | F |
|---|---|---|---|---|
| Polyol | | 1,9-ND adipate | 1,9-ND adipate | 1,9-ND adipate |
| Molecular weight of polyol | | 2,000 | 2,000 | 2,000 |
| Polyisocyanate | | MDI | MDI | MDI |
| Parts of polyisocyanate | | 37 | 43 | 20 |
| Bi-functional crosslinking agent | | PD | PD | PD |
| Melting point of diamino compounds | | — | — | — |
| Relative reaction rate of diamino compound (vs. TCDAM) | | — | — | — |
| Trifunctional crosslinking agent | | TME | TME | TME |
| α value | | 0.95 | 0.95 | 0.95 |
| Diamino compound (mole ratio) in bi-functional crosslinking agent | | — | — | — |
| Triol content (mole ratio) of crosslinking agent | | 0.50 | 0.40 | 0.60 |
| Moldability | | ○ | ○ | ○ |
| Hardness | JIS K6301 | 63 | 67 | 57 |
| 100% M (MPa) | JIS K6251 | 3 | 4 | 2 |
| 200% M (MPa) | JIS K6251 | 5 | 11 | 2 |
| 300% M (MPa) | JIS K6251 | * | * | 3 |
| Tensile strength (MPa) | JIS K6251 | 9 | 16 | 10 |
| Elongation at breakage (%) | JIS K6251 | 250 | 240 | 428 |
| Tear strength (kN/m) | JIS K6252 | 41 | 51 | 29 |
| Young's modulus (MPa) | JIS K6254 | 4.6 | 6.0 | 3.4 |
| Permanent elongation (%) | JIS K6262 | 0.5 | 0.6 | 0.7 |
| Rebound resilience (%) | 10 | 141 | 14 | 65 |
| | 25 | 33 | 29 | 79 |
| | 50 | 66 | 60 | 80 |
| | Δ50-10 | 52 | 46 | 15 |
| Percent edge drooping (%) | | 3.3 | 5.3 | 5.2 |

| | | G | H | I | J |
|---|---|---|---|---|---|
| Polyol | | 1,9-ND adipate | 1,9-ND adipate | PCL | PCL |
| Molecular weight of polyol | | 2,000 | 2,000 | 2,000 | 2,000 |
| Polyisocyanate | | MDI | MDI | MDI | MDI |
| Parts of polyisocyanate | | 55 | 50 | 40 | 40 |
| Bi-functional crosslinking agent | | PD | PD | BD/TCDAM | BD/cure-hard MED |
| Melting point of diamino compounds | | — | — | 151 | 84 |
| Relative reaction rate of diamino compound (vs. TCDAM) | | — | — | 1 | 2 |
| Trifunctional crosslinking agent | | TME | TME | TMP | TMP |
| α value | | 0.95 | 0.95 | 0.95 | 0.95 |
| Diamino compound (mole ratio) in bi-functional crosslinking agent | | — | — | 0.05 | 0.1 |
| Triol content (mole ratio) of crosslinking agent | | 0.20 | 0.25 | 0.10 | 0.10 |
| Moldability | | ○ | ○ | X | X |
| Hardness | JIS K6301 | 82 | 77 | — | — |
| 100% M (MPa) | JIS K6251 | 9 | 7 | | |
| 200% M (MPa) | JIS K6251 | 18 | 16 | | |
| 300% M (MPa) | JIS K6251 | * | * | | |
| Tensile strength (MPa) | JIS K6251 | 29 | 19 | | |
| Elongation at breakage (%) | JIS K6251 | 255 | 215 | | |
| Tear strength (kN/m) | JIS K6252 | 71 | 70 | | |
| Young's modulus (MPa) | JIS K6254 | 12.0 | 9.2 | | |

TABLE 1-continued

| | | | |
|---|---|---|---|
| Permanent elongation (%) | JIS K6262 | 2.8 | 1.6 |
| Rebound resilience (%) | 10 | 20 | 19 |
| | 25 | 30 | 33 |
| | 50 | 54 | 57 |
| | Δ50-10 | 34 | 38 |
| Percent edge drooping (%) | | 8.5 | 7.1 |

* Not measurable due to break

Example 1

The materials for forming polyurethane D and those for forming polyurethane A were sequentially fed to a centrifugal molding machine in predetermined amounts, and centrifugal casting was performed, whereby a cleaning blade member having a cleaning layer (thickness: 0.5 mm) made of polyurethane A and an elastic layer (thickness: 1.5 mm) made of polyurethane D was produced. The cleaning blade member was cut into pieces, and each piece was bonded to a metal plate (support member), to thereby form a cleaning blade of Example 1.

Example 2

The procedure of Example 1 was repeated, except that the materials for forming polyurethane E and those for forming polyurethane B were sequentially fed to a centrifugal molding machine in predetermined amounts, and centrifugal casting was performed, whereby a cleaning blade member having a cleaning layer (thickness: 0.5 mm) made of polyurethane B and an elastic layer (thickness: 1.5 mm) made of polyurethane E was produced, to thereby form a cleaning blade of Example 2.

Example 3

The procedure of Example 1 was repeated, except that the materials for forming polyurethane F and those for forming polyurethane C were sequentially fed to a centrifugal molding machine in predetermined amounts, and centrifugal casting was performed, whereby a cleaning blade member having a cleaning layer (thickness: 0.5 mm) made of polyurethane C and an elastic layer (thickness: 1.5 mm) made of polyurethane F was produced, to thereby form a cleaning blade of Example 3.

Comparative Example 1

The procedure of Example 1 was repeated, except that the materials for forming polyurethane D and those for forming polyurethane G were sequentially fed to a centrifugal molding machine in predetermined amounts, and centrifugal casting was performed, whereby a cleaning blade member having a cleaning layer (thickness: 0.5 mm) made of polyurethane G and an elastic layer (thickness: 1.5 mm) made of polyurethane D was produced, to thereby form a cleaning blade of Comparative Example 1.

Comparative Example 2

The materials for forming polyurethane D and those for forming polyurethane I were sequentially fed to a centrifugal molding machine in predetermined amounts, and centrifugal casting was performed. An elastic layer (thickness: 1.5 mm) made of polyurethane D was produced, but a cleaning layer made of polyurethane I failed to be formed.

Comparative Example 3

The materials for forming polyurethane D and those for forming polyurethane J were sequentially fed to a centrifugal molding machine in predetermined amounts, and centrifugal casting was performed. An elastic layer (thickness: 1.5 mm) made of polyurethane D was produced, but a cleaning layer made of polyurethane J failed to be formed.

Comparative Example 4

The procedure of Example 1 was repeated, except that the materials for forming polyurethane G and those for forming polyurethane A were sequentially fed to a centrifugal molding machine in predetermined amounts, and centrifugal casting was performed, whereby a cleaning blade member having a cleaning layer (thickness: 0.5 mm) made of polyurethane A and an elastic layer (thickness: 1.5 mm) made of polyurethane G was produced, to thereby form a cleaning blade of Comparative Example 4.

Comparative Example 5

The procedure of Example 1 was repeated, except that the materials for forming polyurethane H and those for forming polyurethane A were sequentially fed to a centrifugal molding machine in predetermined amounts, and centrifugal casting was performed, whereby a cleaning blade member having a cleaning layer (thickness: 0.5 mm) made of polyurethane A and an elastic layer (thickness: 1.5 mm) made of polyurethane H was produced, to thereby form a cleaning blade of Comparative Example 5.

Comparative Example 6

The procedure of Example 1 was repeated, except that the materials for forming polyurethane D and those for forming polyurethane A were sequentially fed to a centrifugal molding machine in predetermined amounts, and centrifugal casting was performed, whereby a cleaning blade member having a cleaning layer (thickness: 0.1 mm) made of polyurethane A and an elastic layer (thickness: 1.9 mm) made of polyurethane D was produced, to thereby form a cleaning blade of Comparative Example 6.

Comparative Example 7

The procedure of Example 1 was repeated, except that the materials for forming polyurethane D and those for forming polyurethane A were sequentially fed to a centrifugal molding machine in predetermined amounts, and centrifugal casting was performed, whereby a cleaning blade member having a cleaning layer (thickness: 1.9 mm) made of polyurethane A and an elastic layer (thickness: 0.1 mm) made of polyurethane D was produced, to thereby form a cleaning blade of Comparative Example 7.

Test Example 3

Each of the cleaning blades of the Examples and Comparative Examples 1 and 4 to 7 was adapted in an actual electrophotographic apparatus (product of RICOH, imagio MF351) and the apparatus was performed printing operation 1,000 papers at 5% coverage under LL conditions (10° C., 35%) or HH conditions (30° C., 85%). After completion of the operation, the wear condition of an edge portion of the cleaning blade was observed under a laser microscope, and the amount of wear was microscopically determined. The degree of wearing was evaluated by average cross-section area of wear portions with the following ratings: O (<10 $\mu m^2$), Δ (10 to 20 $\mu m^2$), and X (>20 $\mu m^2$). Each cleaning blade was evaluated in terms of photoreceptor cleaning performance with the following ratings: O (excellent cleaning performance), Δ (poor cleaning performance), and X (cleaning incomplete). The above tests were performed under the following conditions, and the results are shown in Tables 2 and 3.

<Measurement Conditions>

Photoreceptor: OPC, lubricant-coated

Charge conditions (voltage in the apparatus): Vd/−750V, Vl/−50V

Laser microscopy conditions:

Microscope: VK-9500 (KEYENCE Corporation), magnification: ×50

Mode: Ultra-depth color profiling

Optical zoom: ×1.0

Measurement pitch: 0.10 μm

Measurement points: 5 points in each cleaning blade (i.e., points 20 mm from the respective ends, points 80 mm from the respective ends, and the center point)

The percent edge drooping of each of the cleaning blade members of the Examples and Comparative Examples 1 and 4 to 7 was determined in a manner similar to that of Test Example 2. The permanent-deformation resistance of a cleaning blade was evaluated in accordance with the following ratings: O (percent permanent-deformation of ≦8%) and X (percent permanent-deformation of ≧8%). Tables 2 and 3 show the results.

TABLE 2

| | | Ex. 1 | Ex. 2 | Ex. 3 |
|---|---|---|---|---|
| Cleaning layer | Material | A | B | C |
| | Young's Modulus (MPa) | 10.1 | 8.0 | 14.0 |
| | Thickness (mm) | 0.5 | 0.5 | 0.5 |
| | $R_a$: Young's modulus contribution factor | 2.5 | 2.0 | 3.5 |
| Elastic layer | Material | D | E | F |
| | Young's Modulus (MPa) | 4.6 | 6.0 | 3.4 |
| | Thickness (mm) | 1.5 | 1.5 | 1.5 |
| | $R_b$: Young's modulus contribution factor | 3.5 | 4.5 | 2.6 |
| | $R_a + R_b$ | 6.0 | 6.5 | 6.1 |
| | $R_b/R_a$ | 1.37 | 2.25 | 0.73 |
| Wear resistance (HH conditions) | | ○ | ○ | ○ |
| Cleaning performance (LL conditions) | | ○ | ○ | ○ |
| Percent edge drooping (%) | | 4.03 | 6.71 | 6.24 |
| Edge droop resistance | | ○ | ○ | ○ |

TABLE 3

| | | Comp. Ex. 1 | Comp. Ex. 2 | Comp. Ex. 3 |
|---|---|---|---|---|
| Cleaning layer | Material | G | I | J |
| | Young's Modulus (MPa) | 12.0 | — | — |
| | Thickness (mm) | 0.5 | — | — |
| | $R_a$: Young's modulus contribution factor | 3.0 | — | — |
| Elastic layer | Material | D | D | D |
| | Young's Modulus (MPa) | 4.6 | 4.6 | 4.6 |
| | Thickness (mm) | 1.5 | 1.5 | 1.5 |
| | $R_b$: Young's modulus contribution factor | 3.5 | — | — |
| | $R_a + R_b$ | 6.5 | — | — |
| | $R_b/R_a$ | 1.15 | — | — |
| Wear resistance (HH conditions) | | X | — | — |
| Cleaning performance (LL conditions) | | X | | |
| Percent edge drooping (%) | | 4.00 | | |
| Edge droop resistance | | ○ | | |

| | | Comp. Ex. 4 | Comp. Ex. 5 | Comp. Ex. 6 | Comp. Ex. 7 |
|---|---|---|---|---|---|
| Cleaning layer | Material | A | A | A | A |
| | Young's Modulus (MPa) | 10.1 | 10.1 | 10.1 | 10.1 |
| | Thickness (mm) | 0.5 | 0.5 | 0.1 | 1.9 |
| | $R_a$: Young's modulus contribution factor | 2.5 | 2.5 | 0.5 | 9.6 |
| Elastic layer | Material | G | H | D | D |
| | Young's Modulus (MPa) | 12.0 | 9.2 | 4.6 | 4.6 |
| | Thickness (mm) | 1.5 | 1.5 | 1.9 | 0.1 |
| | $R_a$: Young's modulus contribution factor | 9.0 | 6.9 | 4.4 | 0.2 |
| | $R_a + R_b$ | 11.5 | 9.4 | 4.9 | 9.8 |
| | $R_b/R_a$ | 3.56 | 2.73 | 8.65 | 0.02 |
| Wear resistance (HH conditions) | | ○ | ○ | X | ○ |
| Cleaning performance (LL conditions) | | Δ | Δ | X | ○ |
| Percent edge drooping (%) | | 8.22 | 8.08 | 3.84 | 10.58 |
| Edge droop resistance | | X | X | ○ | X |

As is clear from Table 3, the cleaning blades of Examples 1 to 3 exhibited excellent cleaning performance (LL conditions) and excellent wear resistance (HH conditions), and had a percent edge drooping of 6.71% or lower, indicating excellent edge droop resistance.

In contrast, the cleaning blade member of Comparative Example 1 was readily worn and exhibited no cleaning performance, since the cleaning layer thereof was formed from a polyurethane containing no diamino compound. In Comparative Examples 2 and 3, a diamino compound having a melting point of higher than 80° C. was employed as a material for forming the cleaning layer. Therefore, the rate of reaction was excessively high, failing to form a cleaning blade member. The cleaning blade members of Comparative Examples 4 and 5 exhibited poor cleaning performance and low edge droop resistance, since the elastic layers thereof were made of a polyurethane member having a percent edge drooping higher than 7.0%.

The cleaning blade member of Comparative Example 6, having a ratio ($R_b/R_a$) of 8.65 and a Young's modulus ($R_a$+$R_b$) of 4.9 ($R_a$: Young's modulus contribution factor of the cleaning layer, $R_b$: Young's modulus contribution factor of the elastic layer), exhibited characteristics which are almost intrinsic to those of the elastic layer. Therefore, characteristics of the cleaning layer failed to be fully attained and, actually, cleaning could not be performed by means of the cleaning blade member. In addition, the wear resistance of the member was poor. The cleaning blade member of Comparative Example 7, having a ratio ($R_b/R_a$) of 0.02 ($R_a$: Young's modulus contribution factor of the cleaning layer, $R_b$: Young's modulus contribution factor of the elastic layer) exhibited a poor effect of the formed elastic layer and poor edge droop resistance.

What is claimed is:

1. A cleaning blade member for removing toner deposited on an object, the cleaning blade member comprising:

a cleaning layer which contacts the object, and an elastic layer provided on the back surface of the cleaning layer, wherein, the cleaning layer is formed of a polyurethane member produced through curing and molding a castable polyurethane composition comprising a long-chain polyol, a polyisocyanate, and a diamino compound having a melting point of 80° C. or lower, the elastic layer is formed of a polyurethane member produced through curing and molding a castable polyurethane composition comprising a long-chain polyol, a polyisocyanate, a short-chain diol, and a short-chain triol, the polyisocyanate being contained in an amount of 20 to 45 parts by mass with respect to 100 parts by mass of the polyol, and a ratio of the amount by mole of the short-chain triol to the total amount by mole of the short-chain diol and the short chain triol being 0.4 or higher, and has a percent edge drooping of 7.0% or less, the cleaning layer has a Young's modulus contribution factor ($R_a$), and the elastic layer has a Young's modulus contribution factor ($R_b$), with the ratio ($R_b/R_a$) being 0.05 to 6.0, wherein $R_a$ is defined by formula (1):

$$R_a=[T_aE_a/(T_a+T_b)] \quad (1),$$

and $R_b$ is defined by formula (2):

$$R_b=[T_bE_b/(T_a+T_b)] \quad (2),$$

$E_a$ represents the Young's modulus of the cleaning layer; $E_b$ represents the Young's modulus of the elastic layer; $T_a$ represents the thickness of the cleaning layer; and $T_b$ represents the thickness of the elastic layer, and the overall Young's modulus of the cleaning layer and the elastic layer as defined by ($R_a+R_b$) is 5.0 to 14.0 MPa.

2. The cleaning blade member as defined in claim 1, wherein the diamino compound having a melting point of 80° C. or lower contains no chlorine atom but contains an aromatic ring in the molecular structure thereof and exhibits a reaction rate slower than that of 2,2',3,3'-tetrachloro-4,4'-diaminodiphenylmethane under given hardening and molding conditions.

3. The cleaning blade member of claim 1, wherein the percent edge drooping is 8.0% or less.

4. The cleaning blade member of claim 1, wherein the percent edge drooping is 4.0% or more.

5. The cleaning blade member of claim 1, wherein the ratio ($R_b/R_a$) is in a range of 0.73 to 2.25.

6. The cleaning blade member of claim 1, wherein the overall Young's modulus ($R_a+R_b$) is in a range of 6.0 to 6.5 Mpa.

* * * * *